US009346072B2

(12) United States Patent
Ballot

(10) Patent No.: US 9,346,072 B2
(45) Date of Patent: May 24, 2016

(54) PRECISION LIQUID APPLICATOR

(71) Applicant: Flocon, Inc., Cary, IL (US)

(72) Inventor: Stephan M Ballot, Barrington Hills, IL (US)

(73) Assignee: Flocon, INC, Cary, IL (US)

( * ) Notice: Subject to any disclaimer, the term of this patent is extended or adjusted under 35 U.S.C. 154(b) by 1 day.

(21) Appl. No.: 13/829,887

(22) Filed: Mar. 14, 2013

(65) Prior Publication Data

US 2013/0243514 A1 Sep. 19, 2013

Related U.S. Application Data

(60) Provisional application No. 61/611,811, filed on Mar. 16, 2012.

(51) Int. Cl.

| | |
|---|---|
| ***B43K 5/17*** | (2006.01) |
| ***B43K 5/18*** | (2006.01) |
| ***B05C 1/00*** | (2006.01) |
| ***A45D 34/04*** | (2006.01) |
| ***B05C 17/00*** | (2006.01) |
| *B05D 5/00* | (2006.01) |

(52) U.S. Cl.

CPC ..... *B05C 1/00* (2013.01); *A45D 34/042* (2013.01); *A45D 34/045* (2013.01); *B05C 17/00* (2013.01); *B43K 5/1836* (2013.01); *B43K 5/1845* (2013.01); *B05D 5/005* (2013.01)

(58) Field of Classification Search

CPC ..... B43K 5/1836; B43K 5/1845
USPC ..... 401/235, 264; 222/501
See application file for complete search history.

(56) References Cited

U.S. PATENT DOCUMENTS

| | | | | |
|---|---|---|---|---|
| 1,857,467 | A | 5/1932 | Marsh | |
| 2,024,413 | A | 12/1935 | Witt | |
| 2,104,638 | A | 1/1938 | Cuthbert | |
| 2,210,662 | A | 8/1940 | Garvey | |
| 2,330,053 | A | 9/1943 | Herb | |
| 2,611,916 | A | 9/1952 | Prokop et al. | |
| 2,672,875 | A * | 3/1954 | Kovaes | 132/112 |

(Continued)

FOREIGN PATENT DOCUMENTS

| | | |
|---|---|---|
| FR | 995150 | 6/1949 |
| NL | 1016153 | 3/2002 |

*Primary Examiner* — Mark A Laurenzi
*Assistant Examiner* — Joshua Wiljanen
(74) *Attorney, Agent, or Firm* — Frijouf, Rust & Pyle P.A

(57) ABSTRACT

A precision liquid applicator is disclosed for dispensing an applicator liquid from a container onto a surface. The precision liquid applicator comprises a closure defining a terminal orifice and a valve seat. A valve comprises a precision applicator tip extending through the terminal orifice and comprises a valve seal for sealing with the valve seat. A depression of the precision applicator tip onto the surface displaces the valve seal from the sealing surface for providing an annular passageway between the precision applicator tip and the terminal orifice to enable the flow of the applicator liquid onto the surface. A valve stop cooperates with a stop wall for limiting movement of the valve to control a cross-sectional area of the passageway between the precision applicator tip and the terminal orifice and for ensuring the precision applicator tip extends beyond the second end of the closure. The precision liquid applicator is suitable for applying paint into a scratch within a painted surface without excessive application of paint outside of the scratch.

16 Claims, 12 Drawing Sheets

(56) References Cited

U.S. PATENT DOCUMENTS

| | | | | | |
|---|---|---|---|---|---|
| 2,716,250 | A | | 8/1955 | Deakers | |
| 2,805,794 | A | * | 9/1957 | Amon | 222/148 |
| 3,468,611 | A | | 9/1969 | Ward | |
| 3,484,027 | A | | 12/1969 | Micallef | |
| 4,569,612 | A | | 2/1986 | Schwartzman et al. | |
| 4,685,820 | A | * | 8/1987 | Kremer et al. | 401/260 |
| 4,761,090 | A | | 8/1988 | Goh | |
| 4,792,252 | A | | 12/1988 | Kremer et al. | |
| 4,812,071 | A | * | 3/1989 | Batra et al. | 401/264 |
| 4,848,947 | A | | 7/1989 | Kremer et al. | |
| 4,913,175 | A | | 4/1990 | Yokosuka et al. | |
| 4,976,564 | A | | 12/1990 | Fukuoka et al. | |
| 4,984,923 | A | | 1/1991 | Ota | |
| 4,993,859 | A | | 2/1991 | Assad et al. | |
| 5,073,058 | A | * | 12/1991 | Fukuoka et al. | 401/260 |
| 5,261,755 | A | * | 11/1993 | Draper et al. | 401/264 |
| 5,899,624 | A | | 5/1999 | Thompson | |
| 6,010,263 | A | | 1/2000 | White et al. | |
| 6,135,659 | A | * | 10/2000 | Ku | 401/4 |
| 6,513,681 | B2 | | 2/2003 | Gross et al. | |
| 6,634,821 | B2 | | 10/2003 | Gueret | |
| 6,641,320 | B1 | | 11/2003 | Ballot et al. | |
| 6,773,193 | B2 | | 8/2004 | Delage | |
| 6,776,548 | B2 | * | 8/2004 | Gardner et al. | 401/18 |
| 6,817,801 | B1 | | 11/2004 | Colburn et al. | |
| 6,817,802 | B2 | | 11/2004 | Nishitani et al. | |
| 6,883,995 | B1 | | 4/2005 | Gueret | |
| 6,935,536 | B2 | | 8/2005 | Tardif | |
| 6,945,722 | B2 | | 9/2005 | Colburn et al. | |
| 7,101,105 | B2 | | 9/2006 | Reggiani | |
| 7,114,871 | B2 | | 10/2006 | Thiebaut | |
| 7,290,955 | B2 | * | 11/2007 | Patel et al. | 401/264 |
| 7,563,046 | B2 | | 7/2009 | Patel | |
| 7,922,412 | B2 | * | 4/2011 | Miyamoto et al. | 401/264 |
| 8,630,673 | B2 | * | 1/2014 | Chakraborty et al. | 455/509 |
| 2002/0021933 | A1 | | 2/2002 | Knieriemen | |
| 2005/0141951 | A1 | | 6/2005 | Gueret | |
| 2006/0083577 | A1 | | 4/2006 | Gueret | |
| 2009/0103968 | A1 | | 4/2009 | Ballot | |

* cited by examiner

PRECISION LIQUID APPLICATOR

CROSS-REFERENCE TO RELATED APPLICATIONS

This application claims benefit of U.S. Patent Provisional application No. 61/611,811 filed 16 Mar. 2012. All subject matter set forth in provisional application No. 61/611,811 filed 16 Mar. 2012 is hereby incorporated by reference into the present application as if fully set forth herein.

BACKGROUND OF THE INVENTION

1. Field of the Invention

This invention relates to dispensing of liquids and more particularly, this invention relates to a precision liquid applicator for dispensing a liquid on or into a small surface such as a scratch or defect in a paint surface.

2. Description of the Related Art

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have received wide acceptance due in great measure to the convenience of the device. Furthermore, these liquid applicator devices of the prior art had the ability to retain a large quantity of applicator liquid and the ability to supply additional applicator liquid from a liquid container to an applicator tip at the discretion of the user. In addition, the liquid applicator devices were not limited to the dispensing of only writing liquid such as paints, dyes and the like but are capable of dispensing a large variety of applicator liquids including chemicals, perfumes, lubricants and the like.

Continuing efforts have been made in the past to improve the design of the liquid applicator devices. The improvements in the design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid. The fiber applicator tip communicates with the valve mechanism wherein the valve mechanism permits the flow of applicator liquid. In another example, the solid applicator tip comprises an integral component of the valve assembly, wherein depression of the applicator tip enables applicator liquid to flow to the applicator tip.

U.S. Pat. No. 1,857,467 to Marsh discloses a fountain marker comprising a main reservoir adapted to contain fluid with an end wall for the reservoir having an opening. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. The forward end of the valve carries an outwardly projecting shank. A cross-head on the stem having an end is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid.

U.S. Pat. No. 2,029,835 to Reichle discloses an applicator for applying liquids to the skin, hair or the like, and has for its object the provision of an improved form of applicator made of a non-absorbent material such as glass, porcelain, synthetic plastic or the like.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 2,612,162 to Barry discloses a scarifying applicator comprising a container and an apertured cap therefore. A sleeve extends through the cap and having a radially extending flange to be clamped against the container by the cap, the sleeve having an annular spring, seat at its inner end and an inwardly tapered outer end, a headed plunger in the sleeve. The head of the plunger seats against the tapered end of the sleeve. The inner end of the plunger has a slot. A compression spring on the seat has one end received in the slot. The plunger has a generally cylindrical body normally closing the outer end of the sleeve. A reduced portion intermediate its ends has clearance with the outer end of the sleeve upon motion of the plunger inwardly of the sleeve, and scarifying teeth on the outer end of the plunger U.S. Pat. No. 2,714,475 to Roehrich discloses a dispensing type of container of improved, simplified design which is substantially leak-proof and which can be readily and conveniently used for dispensing fluids, including viscous types of fluids such as hand lotion.

U.S. Pat. No. 3,378,330 to Schwartzman discloses an applicator comprising a fluid container having a neck. A retaining ring is fitted in the neck. The retaining ring includes an arcuate inwardly turned re-entrant resilient free edge forming a valve seat. A stepped valve member is provided and is movable with respect to the valve seat to control fluid flow through the retaining ring. The re-entrant free edge engages the sides and upper surfaces of the stepped valve member to successively form an initial seal and a secondary seal.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 3,484,027 to Micallef discloses a valve closure for dispensing liquids from a container comprising a cap member attached to one end of the container having a centrally located boss member extending towards the interior of the container. An aperture in the boss member and a flange member is spaced from the boss member and adapted to engage the inside of the mouth of the container in sealing relationship. A valve member including a valve stern is mounted for rotation in the boss member. The valve stern has communicating radial and axial openings with an opening in the boss member being adapted to communicate with the radial opening thereby permitting selective opening and closing of the valve closure. A radially resilient extension extends from one end of the valve stem. The extension has portions which are radially compressible to permit assembly of the valve stem member and the boss member. The radially extending portions are adapted to cooperate with the boss member to prevent disassembly of the valve and the boss member, wherein the resilient extension has a semi-circular shape.

U.S. Pat. No. 3,540,636 to Dvoracek discloses a dispensing valve for liquid soaps or the like comprising a valve body having a downwardly disposed outlet in part defined by a radially outwardly facing frusto-conical valve seat. A valve element of generally inverted cone shape has its base in the valve body and its apex disposed below the outlet in the valve body. The base of the valve element has a downwardly directed skirt or flange. The inner wall of which comprises a seating surface adapted to engage the valve seat at an acute angle. The valve seat flange, or the seating flange or skirt of the body comprises a slightly resilient material, preferably plastic, to provide a wiping seating action of the seating surface against the seat.

U.S. Pat. No. 3,551,065 to Varettoni de Molin, et al. discloses an improved valving construction for felt nib marking devices including a body member forming a chamber at an upper end thereof in direct contact with a supply of inking material. A reciprocating resiliently urged valve is disposed within the chamber, and a bore communicates directly with the lower end of the chamber. A grooved elongated felt nib disposed within the bore projects outwardly thereof at the lower end of the bore. Pressure applied to the lower end of the nib forces the same to project the upper end thereof directly into the chamber against the action of resilient means operating upon the valve. Upon the release of pressure, the valve may exert a pumping action forcing inking material into direct communication with the grooves in the nib to be conducted rapidly to the exposed lower end of the nib.

U.S. Pat. No. 3,680,968 to Schwartzman, et al. discloses a method of correcting a typewritten impression comprising the steps of centering an applicator containing a correction liquid and having a liquid outlet and a valve head extending through the liquid outlet for controlling flow of correction liquid through the liquid outlet in overlying relationship relative to a typed impression with the valve head engaging substantially the center of the typewritten impression. Therefore, the correction liquid is ejected from the applicator to form a disc of correction liquid having a ring of greatest thickness adjacent the periphery of the disc and surrounding the impression to be corrected, and then allowing the disc of correction liquid to dry.

U.S. Pat. No. 4,543,005 to Kuboshima discloses a container for an instantaneous adhesive and more particularly to an arrangement of a so-called pencil-type container which contains the instantaneous adhesive therein. Through use of the present invention, an appropriate small amount of the instantaneous adhesive can be delivered on a part to be bonded through a nozzle disposed at the upper end of the container by urging the top of the container against the part to be bonded. The container is sealed when not in use through a novel spring mechanism which closes the container urging a nozzle against the opening at the tip of the casing.

U.S. Pat. No. 4,685,820 to Kremer et al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et al. provided a significant step forward in the art of liquid applicator devices.

U.S. Pat. No. 4,792,252 to Kremer et al. discloses a liquid applicator device for applying a liquid such as a paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension which holds the inner end of the surface applicator to maintain the liquid seal during lateral movement of the outer end of the surface applicator.

U.S. Pat. No. 4,848,947 to Kremer, et al. discloses an improved applicator device for applying an applicator liquid such as a chemical, a coating, a solvent or other suitable liquids to a surface. The device comprises a container for containing the applicator liquid and a tilt valve secured to the container. The tilt valve has a valve element normally biased into a closed position. The valve element inhibits the flow of the applicator liquid from the container when the valve element is in the closed position and permits the flow of the applicator liquid from the container when the valve element is tilted into an open position. A surface applicator has a proximal end for receiving the applicator liquid flowing through the tilt valve and has a distal end adapted to apply the applicator liquid to the surface. Means are provided for allowing a user to laterally move the surface applicator for enabling the proximal end of the surface applicator to tilt the valve element into the open position to permit the flow of the applicator liquid from the container to the proximal end to replenish the applicator liquid at the distal end of the surface applicator. The surface applicator may be a flexible applicator such as an applicator brush, a flexible fiber tip or the like which permits a user to disperse or paint the applicator liquid on a surface. The improved applicator device is suitable for dispensing a wide variety of liquid products including inks, dyes, paints, coatings, chemicals, insect repellants, perfumes, solvents and the like.

U.S. Pat. No. 4,935,001 to George discloses a swab for collecting and removing material from small openings. The swab includes an absorbent tip attached to an elongated rod. The absorbent tip has an outer surface with at least one recess in which material is collected.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,913,175 to Yokosuka et al. discloses a liquid-applying tip assembly in which the liquid-applying member is pushed to operate the valve to allow the liquid to flow to the liquid-applying member. The liquid-applying member is a plastic member which comprises: a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

U.S. Pat. No. 5,073,058 to Fukuoka, et al. discloses an implement for applying a liquid including a container for holding liquid. The container has a front end which is open and a front tube mounted on the front end of the container. The front tube has a forward outlet opening. A hollow accommodating member has an interior chamber, the accommodating member has a rear opening communicating the interior chamber with the container and a forward opening communicating the interior chamber with the front tube. A liquid feed member is movably disposed in the interior chamber between a closed position in which the liquid feed member engages the forward opening to block off communication between the interior chamber and the front tube and an open position in which the liquid feed member is disengaged from the forward opening. An end valve is axially movable in the front tube between a closed position and an open position and an open position. An applicator is mounted on the end valve. The liquid feed member is constructed such that when the implement is axially shaken, the liquid feed member temporarily moves from its closed position to its open position to pass liquid from the interior chamber of the accommodating member to the applicator.

U.S. Pat. No. 5,123,431 to Wilson discloses a cosmetic applicator tip having a plurality of dimples on an exterior surface thereof for receiving and dispensing a cosmetic. The tip is injection molded from a soft material to provide the tip with a pleasing "feel" when rubbed against the skin of a user. An air cushion within the tip can be varied to adjust or regulate the "feel" of the tip.

U.S. Pat. No. 5,388,700 to Per-Lee discloses a device for applying skin treatment substances to the back of a person including a manually grippable elongated shaft having a head formed thereon, and a plurality of contact pads, each selectively engageable with and disengageable from the head without damaging the head or pads. A first contact pad has a non-porous contact surface for applying relatively viscous substances to the skin of the person, a second contact pad has a porous contact surface for retaining relatively non-viscous substances for applying the relatively non-viscous substances to the skin of the person, and a third contact pad has a sisal contact surface for cleansing the skin of the person. Also, a fourth contact pad has an erose surface for gently scratching the person's back when rubbed against it. A bag is provided for holding the shaft and contact pads.

U.S. Pat. No. 5,568,990 to McAuley discloses a liquid applicator providing for a self-sealing feature, which applicator comprises a housing, a valve member and a spring member. The housing has an aperture through its top wall and an annular sleeve projecting inwardly from an edge of the top wall in a surrounding relation with the aperture, the annular sleeve having an end portion. The valve member includes an actuating part that is slideably received by the annular sleeve and a sealing part that is shaped to form a releasable seal with the end portion of the annular sleeve. The valve and spring members are disposed in an axially displaceable relation such that the actuating part of the valve member is resiliently urged into the annular sleeve; that a part of the actuating part protrudes from the top wall of the housing; and that the sealing part of the valve member sealably engages with the end portion of the annular sleeve.

U.S. Pat. No. 5,851,079 to Horstman, et al. discloses a unidirectional twist-up dispensing device with incremental dosing for dispensing a product. This twist-up dispensing device includes a hollow housing defining a chamber having an open dispensing end and an open actuating end having an interior surface. A piston located within the chamber being limited to translational movement within the chamber. The piston having a top side facing the dispensing end of the housing forming a variable volume portion of the chamber for storing the product. The piston also has a threaded rod extending therefrom opposite the top side. An actuator having a threaded aperture therethrough that engages the interior surface at the actuating end of the housing is also provided. The threaded aperture is concentric in the actuator and the actuator is adapted to rotate with respect to the housing in only one direction. The threaded rod engages the threaded aperture such that advancement of the piston toward the dispensing end occurs when the actuator is rotated, thereby causing the product to be dispensed. An applicator can be attached to the dispensing end of the housing in fluid communication with the variable volume portion of the chamber wherein the product is dispensed through the applicator. The applicator comprises a ferrule and an application portion. The ferrule is attached to the dispensing end of the housing and the application portion has at least one orifice located therein. Several versions of the applicator are illustrated, including a fiber brush and a flocked application surface.

U.S. Pat. No. 5,888,005 to Gueret discloses a capillary dosing unit including a stem with an axis of symmetry, a grip at a first end of the stem and at least one slit at a second end of the stem which emerges along the axis of the stem. This dosing unit allows accurate dosing of a liquid such as a nailcare oil.

U.S. Pat. No. 6,315,482 to Girardot, et al. discloses an applicator for applying and distributing a substance onto a target surface. The applicator comprises a substantially planar sheet of compressible, conformable material having opposed first and second surfaces and an interior region between the first and second surfaces. The sheet of material has a thickness between the first and second surfaces which decreases when the sheet of material is subjected to an externally-applied force in a direction substantially normal to the first surface. The applicator further includes at least one discrete reservoir extending inwardly of the first surface into the interior of the sheet of material which is at least partially filled with a substance and at least one discrete aperture formed in the first surface which is in fluid communication with the reservoir. Compression of the sheet of material via an externally-applied force substantially normal to the first surface expresses product from the aperture and translational motion of the first surface relative to a target surface applies and distributes the product onto the target surface. In a preferred embodiment, a plurality of apertures are associated with corresponding reservoirs forming a delivery zone near one end of a hand-held applicator, and the sheet material is preferably resilient both in compression and in bending to conform to irregular target surfaces. A wide variety of substances are contemplated, including particularly antiperspirant/deodorant products. Other embodiments include a single reservoir feeding a plurality of apertures.

U.S. Pat. No. 6,322,271 to Girardot, et al. discloses an applicator for applying and distributing a substance onto a target surface. The applicator comprises a substantially planar sheet of conformable material having opposed first and second surfaces and an interior region between the first and second surfaces. The sheet of material has a thickness between the first and second surfaces. The applicator further includes at least one discrete reservoir underneath the first surface which is at least partially filled with a substance and at least one discrete aperture formed in the first surface which is in fluid communication with the reservoir. Compression of the applicator via an externally-applied force substantially normal to the first surface expresses product from the aperture and translational motion of the first surface relative to a target surface applies and distributes the product onto the target surface. A removable cover sheet which aids in the containment of the substance and also contributes to a pre-removal stiffness value for the applicator such that the pre-removal stiffness value is at least three times greater than a post-removal stiffness value for the applicator. The stiffness of the removable cover sheet can also provide protection against bending that could lead to failure of the containment, against puncture, and against other damage to the product rheology, homogeneity, etc. A wide variety of substances are contemplated, including particularly antiperspirant/deodorant products.

U.S. Pat. No. 6,513,681 to Gross et al. discloses a spray dispensing closure including a spray plug and a cap cooperating therewith to selectively occlude passages in the spray plug. A spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber which are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages extend from a proximal end of the dip tube. A plurality of dip tube end engaging ribs extend from the spray plug. When the container is squeezed and the cap is open, product is conveyed from the dip tube and into the inner passages to be mixed with air from the head space.

U.S. Pat. No. 6,634,821 to Gueret discloses a device and system for applying a product, for example, a cosmetic product. The device includes a first compartment containing the product, and a second compartment in flow communication with the first compartment via at least one supply orifice, with the second compartment having an opening which may be removably closed by a closure element. The second compartment may form a housing for an applicator which is insoluble with respect to the product. The applicator may rest against an elastically compressible porous member that may be in flow communication with the supply orifice.

U.S. Pat. No. 6,684,887 to Alexander discloses a hair separator and fluid applicator that includes a central handle portion, a parting portion disposed adjacent the central handle portion, and an applying portion disposed adjacent the central handle portion opposite the parting portion. The parting portion includes a proximal end and a distal end, the distal end being disposed opposite the central handle portion and generally narrowing from the proximal end to the distal end. The parting portion also may include a generally concave face. The applying portion includes a blade. The blade includes dimples or holes designed to increase the ability of less-viscous fluids or creams to remain adhered to the surface of the blade. The applying portion may also include teeth disposed along a distal portion for assisting in the application and directional smoothing of the hair during use. The channels between the teeth may vary in shape, including (for example) being half-circular, ovular or rectangular in shape.

U.S. Pat. No. 6,773,193 to Delage discloses a device for packaging and applying a substance, in particular a cosmetic or a care product, the device comprising a receptacle for containing the substance. The receptacle is provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position. The intermediate reservoir-forming element are arranged to enable the substance retained in this way to feed the applicator, at least in certain conditions of use of the device.

U.S. Pat. No. 6,817,801 to Colburn et al. discloses an applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

U.S. Pat. No. 6,817,802 to Nishitani et al. discloses a writing instrument adapted, responsive to a pressure axially applied to a pen core, to supply ink in an ink chamber to the pen core. The writing instrument includes a valve seat disposed between the ink chamber and the pen core. A valve body is operable to be selectively moved between a close position where the valve body is in contact with the valve seat to isolate the pen core from the ink chamber and an open position where the valve body is spaced apart from the valve seat to communicate the pen core with the ink chamber. A pressing spring biases the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the close position that when it is in the open position. The writing instrument can reduce the deposit of ink pigments around the valve body to prevent occurrence of defect in the operation of the valve body.

U.S. Pat. No. 6,945,722 to Colburn et al. discloses a tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

U.S. Pat. No. 7,101,105 to Reggiani discloses a container-applicator for fluid products for cosmetic and pharmaceutical use. An applicator is provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

U.S. Pat. No. 7,114,871 to Thiebaut discloses a packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

In my prior U.S. Pat. No. 6,641,320, I disclosed an improvement to U.S. Pat. No. 4,685,820 to Kremer et al. comprising an applicator tip having a recess and a generally toroidal retaining ring disposed in the recess of the applicator tip. The recess cooperates with the retaining ring for preventing removal of the applicator tip from the liquid applicator device.

U.S. Patent Application 2008/0170904 to Bayly, et al. discloses an implement for applying a volume of liquid to a treatment surface. The implement includes a support means onto which is mounted a receptacle. The receptacle defines a reservoir space which receives the liquid. The receptacle includes a wall having a working surface that is used to spread the liquid over the treatment surface. The wall is resiliently deformable so in use the working surface maintains contact with the treatment surface when spreading the liquid. The implement has a specific application in applying a transdermal lotion to the axilla area of the user. The invention also relates to a system for transdermal administration of a physiological active agent from a liquid composition and a method of conducting the same.

Although the above patents and patent applications have contributed substantially to the art, none of the aforementioned liquid dispensers were capable of dispensing an applicator liquid such as paint to a very small surface without dispersing the applicator liquid to an adjacent area.

Therefore, it is an object of the present invention is to provide a precision liquid applicator capable of applying an applicator liquid in a precise manner heretofore unknown in the art.

Another object of the present invention is to provide a precision liquid applicator capable of applying an applicator liquid to a small area without dispersing the applicator liquid to an adjacent area.

Another object of the present invention is to provide a precision liquid applicator that has a reduced number of parts.

Another object of the present invention is to provide a precision liquid applicator that that requires a reduced number of stages for assembly.

Another object of the present invention is to provide a precision liquid applicator that may be used with existing containers.

Another object of the present invention is to provide precision liquid applicator that may be used with liquids previously unusable in the liquid applicator devices of the prior art.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to a precision liquid applicator for dispensing an applicator liquid from a container onto a surface. The precision liquid applicator comprises a closure secured to the container. The closure has an internal closure orifice defining a terminal orifice with a sealing seat adjacent to the terminal orifice. A valve has a precision applicator tip with a valve seal located adjacent to the precision applicator tip. A biasing spring urges the valve seal of the valve into engagement with the sealing seat of the closure for inhibiting the flow of the applicator liquid from the terminal orifice. A depression of the precision applicator tip onto the surface displaces the valve seal from the sealing surface for providing an annular passageway between the precision applicator tip and the terminal orifice to enable the flow of the applicator liquid onto the surface. A valve stop is located on the valve cooperating with a stop wall for limiting movement of the valve to control a cross-sectional area of the passageway between the precision applicator tip and the terminal orifice and for ensuring the precision applicator tip extends beyond the second end of the closure.

In a more specific embodiment of the invention, the sealing seat comprises an intersection of an outwardly tapered portion immediately adjacent to the terminal orifice of the closure. The valve seal comprises an outwardly tapered region extending from valve adjacent to the precision applicator tip.

The valve stop cooperates with the stop wall to establish a desired a cross-sectional area of the passageway between the precision applicator tip and the terminal orifice upon total depression of the precision applicator tip. A dimension of one of the valve stop and the stop wall is selected relative to a viscosity of the applicator liquid for establishing a desired a cross-sectional area of the passageway between the precision applicator tip and the terminal orifice to provide a desired flow of the applicator liquid to the precision applicator tip. The valve stop cooperates with a stop wall for limiting movement of the valve to control a cross-sectional area of the passageway between the precision applicator tip and the terminal orifice for controlling the flow of the applicator liquid to minimize the application of the applicator liquid to areas adjacent to the intended area of application on the surface.

The invention is also incorporated into a precision liquid applicator for dispensing a paint liquid from a container onto a scratch in a painted surface. The precision liquid applicator comprises a closure secured to the container. The closure has an internal closure orifice defining a terminal orifice with a sealing seat adjacent to the terminal orifice. A valve having a precision applicator tip with a valve seal is located adjacent to the precision applicator tip. A biasing spring urges the valve seal of the valve into engagement with the sealing seat of the closure for inhibiting the flow of the paint from the terminal orifice. A depression of the precision applicator tip onto the scratch of the paint surface displaces the valve seal from the sealing surface for providing an annular passageway between the precision applicator tip and the terminal orifice to enable the flow of the paint into the scratch in the paint surface. A valve stop is located on the valve cooperating with a stop wall for limiting movement of the valve to control a cross-sectional area of the passageway between the precision applicator tip and the terminal orifice for controlling the flow of the paint and for ensuring the precision applicator tip extends beyond the second end of the closure to minimize the application of the paint to areas adjacent to the scratch in the paint surface.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
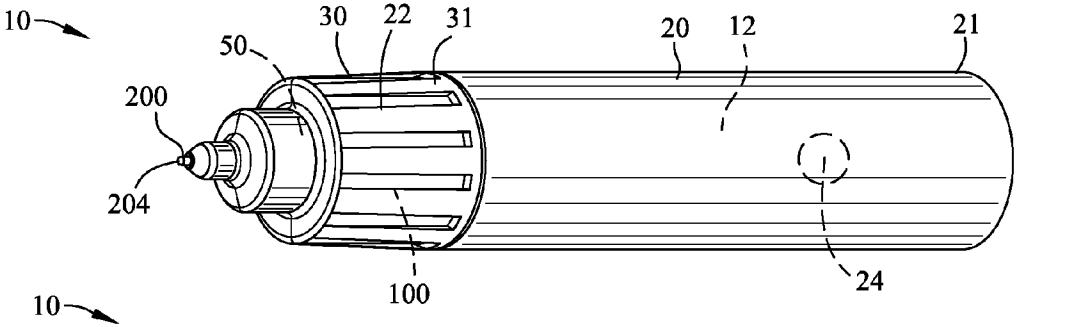
FIG. 1 is an isometric view of the precision liquid applicator of the present invention.
Figure 2:
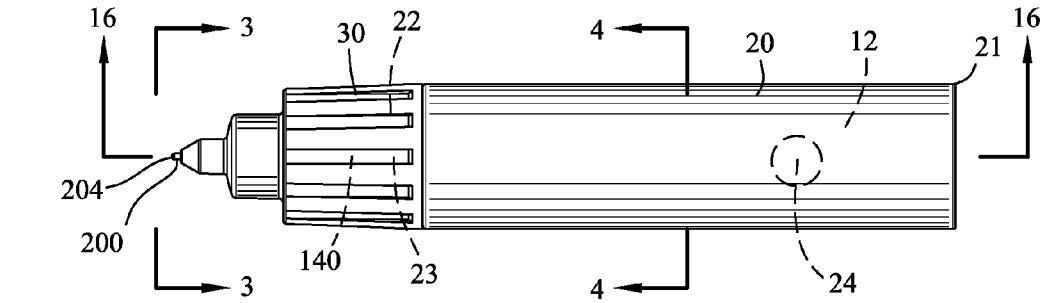
FIG. 2 is a side view of the precision liquid applicator of FIG. 1.
Figure 4:
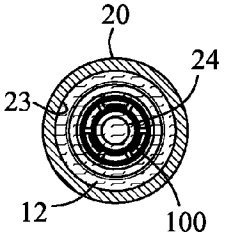
FIG. 4 is view along line 4-4 in FIG. 2.
Figure 3:
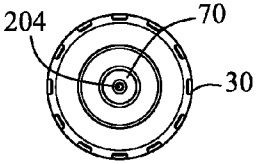
FIG. 3 is view along line 3-3 in FIG. 2.

FIGS. 1-4 are various views of the precision liquid applicator 10 for dispensing an applicator liquid 12 from a container 20. The container extends between a first end 21 and the second end 22. The first end 21 of the container is closed in a conventional manner where as the second end 22 is an open end as indicated by 23 for providing liquid flow from the container 20 and the precision liquid applicator 10.

The container 20 is shown as a metallic container but it should be appreciated that the container 20 may be formed of other materials such as glass or polymeric materials. In addition, the shape of the container 20 forms no part of the present invention. An optional agitator 24 may be incorporate within the container 20 for a mixing the applicator liquid 12 in the event such mixing is required for a specific applicator liquid 12 used with the precision liquid applicator 10.

Figure 5:
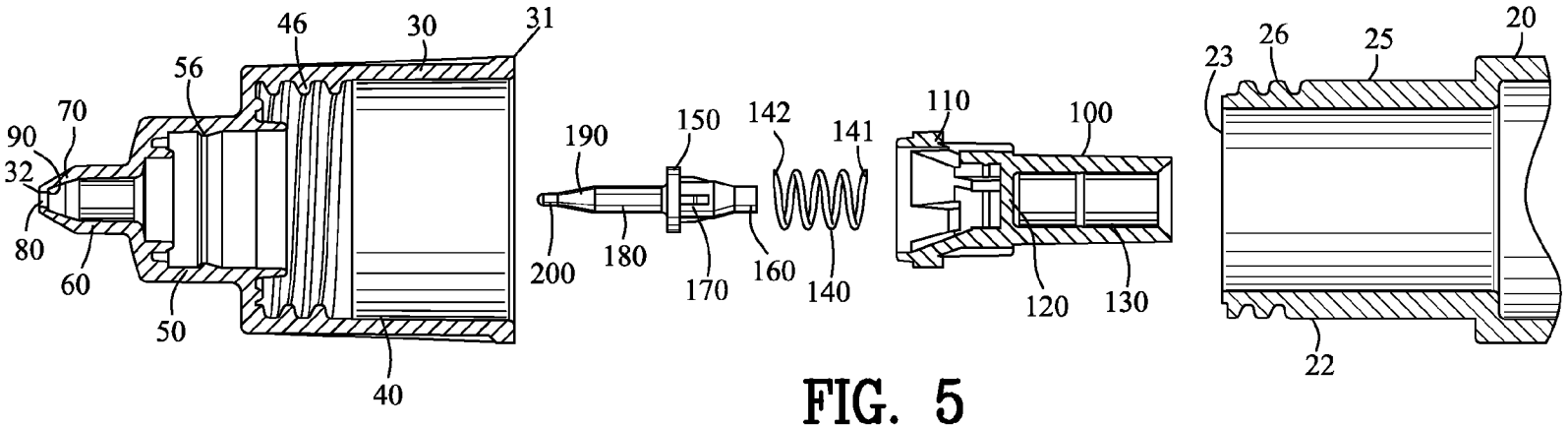
FIG. 5 is an enlarged exploded view of the precision liquid applicator of FIGS. 1-4.
Figure 6:
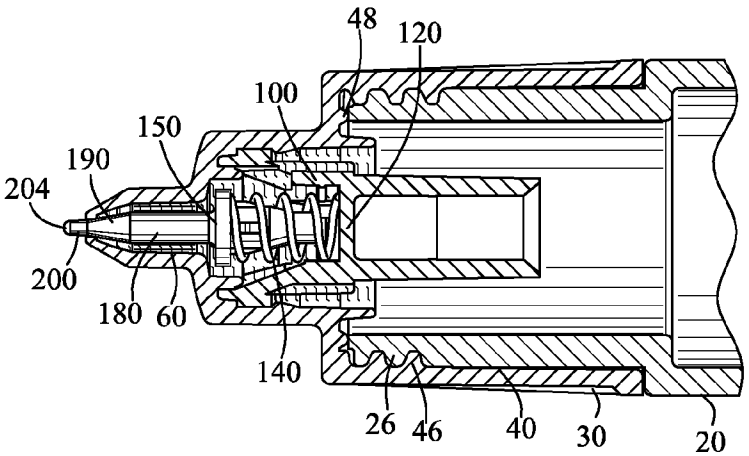
FIG. 6 is an assembled view of the precision liquid applicator of FIG. 5.

FIGS. 5 and 6 are enlarged exploded and assembled views of the precision liquid applicator of FIGS. 1-4. The container 20 has a recess 25 terminating in threads 26 for affixing the precision liquid applicator 10 to the container 20. Although threads 26 are shown for affixing the precision liquid applicator 10 to the container 20, it should be understood that the precision liquid applicator 10 may be affixed to the container 20 in numerous other way well known in the art.

The precision liquid applicator 10 comprises a closure 30, a retainer 100, a bias spring 140 and a valve 150. Preferably each of the closure 30, the retainer 100 and the valve 150 are formed of a one-piece molded polymeric material.

Figure 7:
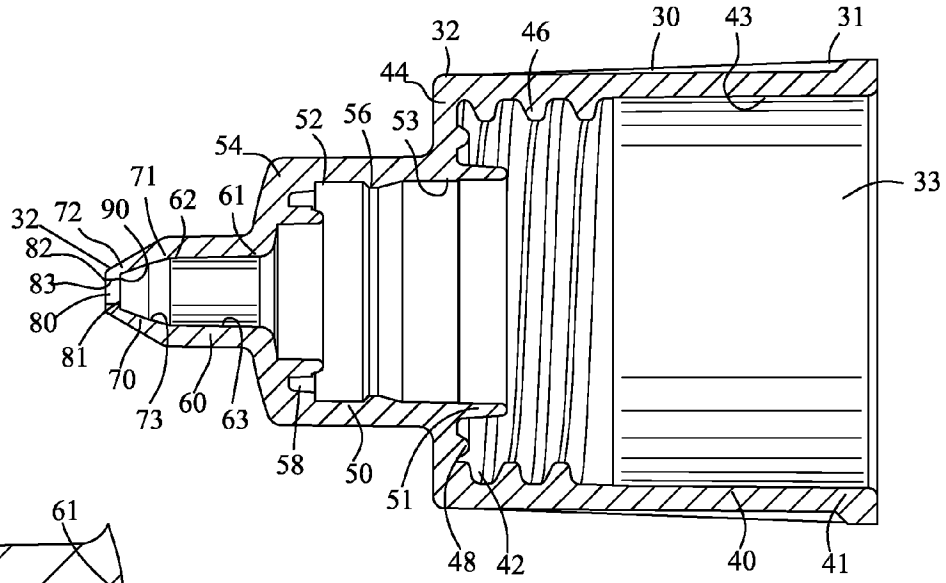
FIG. 7 is an enlarged view of a closure portion of FIGS. 5 and 6.

FIG. 7 is an enlarged view of the closure 30 of FIGS. 5 and 6. The closure 30 defines a first end 31 and a second 32 with a through orifice 33 extending therebetween. The closure 30 defines a closure mounting portion 40 extending between a first end 41 and a second end 42 with an internal diameter of 43. A transverse wall 44 extends inwardly from the second end 42 of the closure mounting portion 40.

Threads 46 are formed in proximity to the second end 42 of the closure mounting portion 40 of the closure 30. A sealing projection 48 extends from the transverse wall 44 of the closure mounting portion 40 of the closure 30. The sealing projection 48 extends from the transverse wall to provide a seal with the second end 22 of the container 20. The threads 46 of the closure 30 cooperate with the threads 26 of the container 20 for providing a compression liquid seal between the sealing protection 48 and the second end 22 of the container 20.

The closure 30 comprises a retainer receiving portion 50 extending between a first end 51 and a second end 52 and defines an internal diameter of 53. The internal diameter of 53 of the retainer receiving portion 50 is smaller than the internal diameter of 43 of the closure mounting portion 40. An abutment wall 54 extends inwardly from the second end 52 of the retainer receiving portion 50. The container receiving portion 50 includes an axially inwardly extending annular projection 56. A recess 58 is defined within the abutment wall 54 the function of which will be described in greater detail hereinafter.

The closure 30 includes a valve guide 60 extending between a first end 61 and a second end 62 defining a cylindrical internal diameter 63. The first end 61 of the valve guide 60 extends from an inward end of the abutment wall 54.

Figure 8:
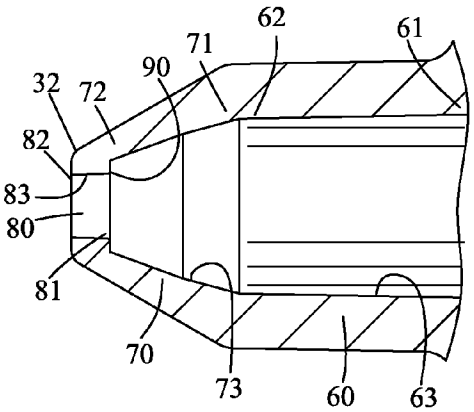
FIG. 8 is a magnified view of a terminal orifice of FIG. 7.

FIG. 8 is a magnified view of a portion of FIG. 7. A tapering portion 70 extends between the first end 71 and a second end 72. The first end 71 of the tapered portion 70 is coincident with the second end 62 of the guide 60. The tapered portion 70 defines a variable diameter 73 from a large diameter at the first end 71 to a small diameter at the second end 72. The change in the variable diameter 73 may be linear of non-linear depending upon the design choice and intended use.

A terminal orifice 80 is defined in the second is 32 of the closure 30. The terminal orifice 80 extends between a first end 81 and a second end 82 and defines a cylindrical internal diameter 83. The first end 81 of the terminal orifice 80 is coincident with the second end 72 of the tapered portion 70. The intersection of the first end 81 of the terminal orifice 80 and the second end 72 of the tapered portion 70 defines a sealing seat 90 of the closure 30.

Figure 9:
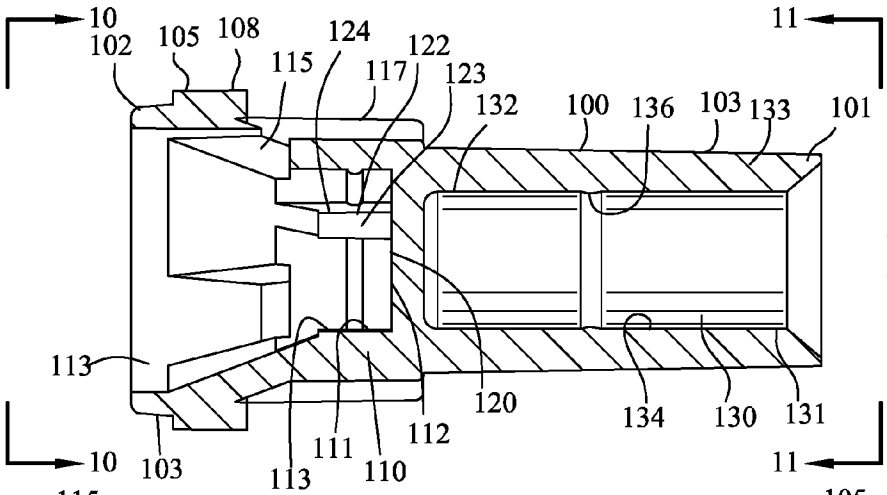
FIG. 9 is an enlarged view of a retainer of FIGS. 5 and 6.
Figure 11:
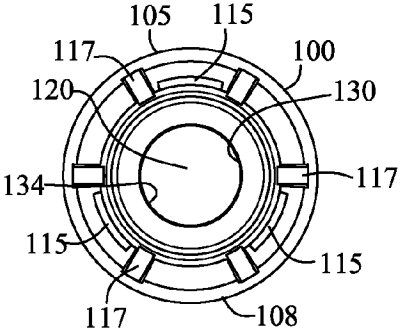
FIG. 11 is a view along line 11-11 in FIG. 9.
Figure 10:
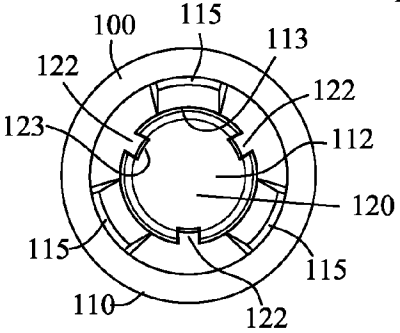
FIG. 10 is a view along line 10-10 in FIG. 9.

FIGS. 9-11 are enlarged views of a retainer 100 of FIGS. 5 and 6. The retainer 100 extends between the first end 101 and a second end 102. The second end 102 of the retainer defines an outer diameter 103 supporting an annular boss 105. The annular boss 105 defines an outer diameter 108 commensurate with the internal diameter 53 of the retainer mount 50 of the closure 30. The retainer 100 includes a retainer cup 110 having a cylindrical sidewall 111 and a bottom wall 112. The retainer cup 110 has an internal diameter 113.

A plurality of apertures 115 are defined in the cylindrical sidewall 111 for enabling the flow of the applicator liquid 12 from an exterior of the retainer cup 110 to an interior of the retainer cup 110. A plurality of external ribs 117 extend from an outer surface of the retainer cup 110 to engage with the internal diameter 53 of the retainer mount 50 of the closure 30.

In this embodiment, the bottom wall 112 functions as a stop wall 120 for limiting the movement of the valve 150 as will be described in greater detail hereinafter. It should be appreciated by those skilled in the art that the stop wall 120 may be a separate member and not be incorporated into the bottom wall 112 of the retainer cup 110.

A plurality of internal ribs 122 are located internal the retainer cup 110. The plurality of internal ribs 122 define an internal diameter 123 for slidably supporting the valve 150. In addition, an end 124 of the internal ribs 122 provide a support for the spring 140 as will be described in greater detail hereinafter.

An optional socket 130 is incorporated into the retainer 100. The socket 130 extends between a first end 131 and a second end 132 having a socket tubular sidewall 133 defining an internal diameter 134. The socket 130 incorporates the bottom wall 112 of the retainer cup 110. An annular projection 136 extends from the socket tubular sidewall 133 into the internal diameter 134 the function of which will be described in greater detail hereinafter.

Referring back to FIGS. 5 and 6, the spring 140 extends from a first end 141 to a second end 142. The spring 140 is shown as a conventional coil spring made of a metallic material. However, is should be appreciated by those skilled in the art that the precision liquid applicator 10 may incorporate other types biasing devices such as plastic springs and the like.

Figure 12:
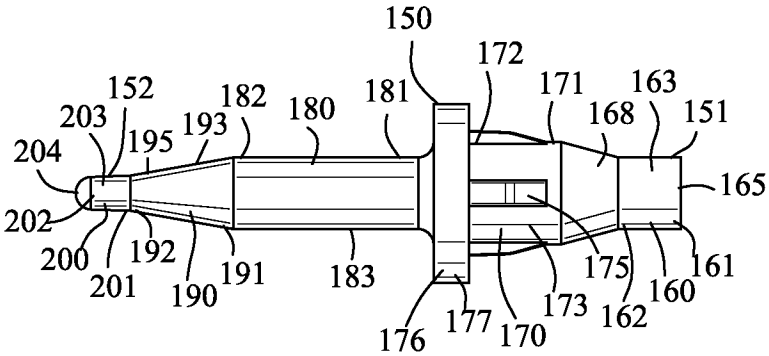
FIG. 12 is an enlarged view of a valve portion of FIGS. 5 and 6.
Figure 14:
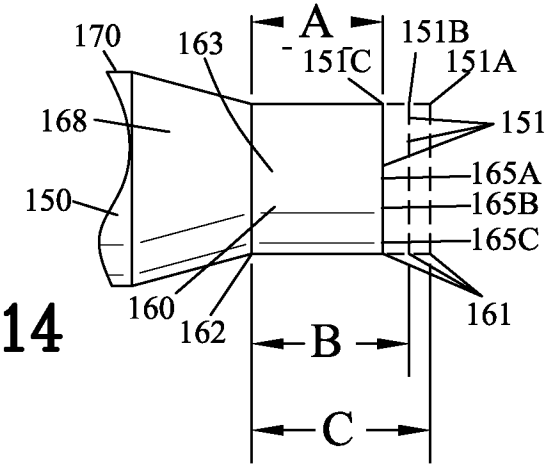
FIG. 14 is a magnified view of a stop portion of FIG. 12.
Figure 13:
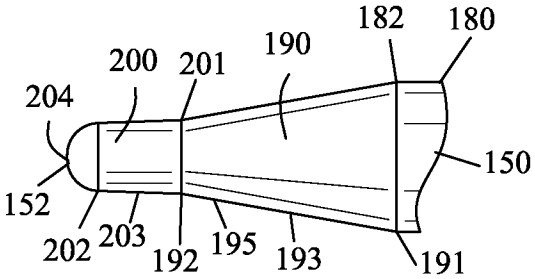
FIG. 13 is a magnified view of a precision applicator tip of FIG. 12.

FIGS. 12-14 are enlarged views of a valve portion of FIGS. 5 and 6. The valve 150 extends between a first end 151 and a second end 152. The valve stop 160 extends between a first end 161 and a second end 162 and defines an outer diameter 163. A valve stop surface 165 is coincident with the first end 151 of the valve 150. A transition region 168 is interposed between the valve stop 160 and a spring engaging region 170.

The spring engaging region 170 extends between a first end 171 and a second end 172 and defines an outer diameter 173. A plurality of alignment ribs 175 extend from the outer diameter 173 of the spring engaging region 170. A flange 176 extends from the second end 172 of the spring engaging region 170. The flange 176 has an outer flange diameter 177 larger than the outer diameter 173.

A guide 180 extends between a first end 181 and a second 182. The guide 180 has an outer cylindrical diameter 183 dimensioned to be commensurate with the cylindrical internal diameter 63 of the valve guide 60 of the closure 30.

The valve 150 includes a valve seal 190 extending from a first end 191 to a second end 192. The first end 191 of the valve seal is coincident with the second end 182 of the guide 180. The valve seal 190 varies in outer diameter 193 between a first end 191 having a large diameter to a second end 192 having a small diameter. The change in the variable outer diameter 193 may be linear or non-linear depending design choice and intended use. The variable outer diameter 193 defines a valve seal 195.

The valve 150 includes a precision applicator tip 200 defining a first end 201 and a second end 202. The precision applicator tip 200 has a cylindrical outer diameter to 203. The first end 201 of the precision applicator tip 201 is coincident with the second end 192 of valve seal 190.

The second end 202 of the precision applicator tip 200 is shown as a hemispherical tip 204 but it should be understood that the configurations of the second end 202 of the precision applicator tip 200 may be chosen for a specific liquid application.

An important aspect of the present invention resides in the ability to control the flow rate of the applicator liquid 12 to the precision applicator tip 200. The ability to control the flow rate of the applicator liquid 12 to the precision applicator tip 200 enables the precision liquid applicator 10 to be adapted to accommodate for various flow rates and various viscosities of the applicator liquid 12. As will be described in greater detail hereinafter, the ability to adapt for various flow rates and various viscosities of the applicator liquid 12 resides in part in forming the valve 150 to have various lengths between the first end 151 and the second end 152.

As best shown in FIG. 14, the valve 150 may be formed to provide various lengths between the first end 151 and the second end 152 of the valve 150. Three examples of the length of the valve 150 are shown in FIG. 14 as first end 151A, first end 151B and first end 151C. The first end 151A, first end 151B and first end 151C define valve stop surface 165A, valve stop surface 165B and valve stop surface 165C. Although only three examples of the length of the valve 150 are shown in FIG. 14, it should be understood and various other lengths of the valve 150 may be incorporated into the present invention.

Figure 15:
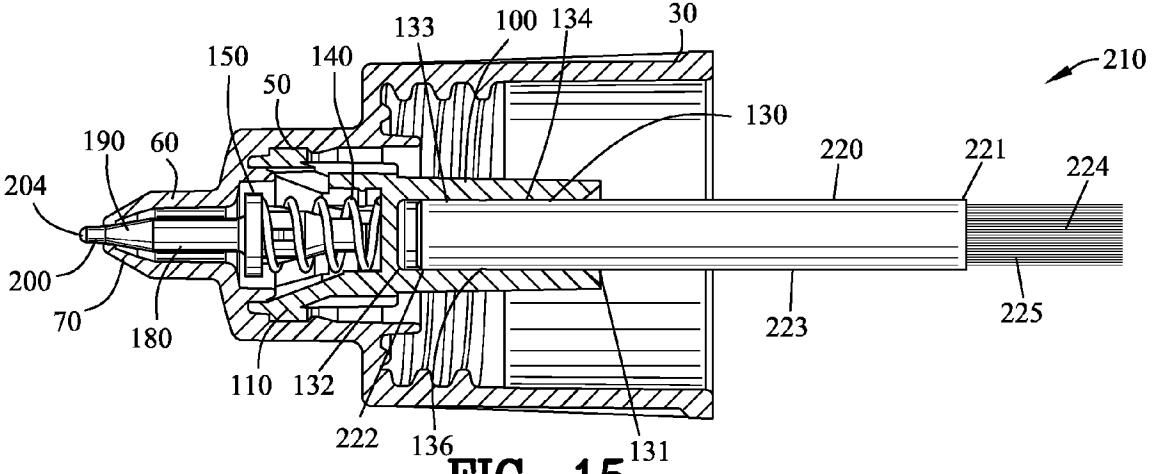
FIG. 15 is a second embodiment of the present invention with the precision liquid applicator incorporating a secondary tool shown as a brush.

FIG. 15 is illustrates the precision liquid applicator 10 incorporating a tool 210 inserted into the optional socket 130 of the retainer 100. The tool 210 comprises a shaft 220 extending between a first end 221 and a second end 222. The shaft 220 defines an outer diameter 223 commensurate with the internal diameter 134 of the socket 130 of the retainer 100.

In this example, the first end 221 of the shaft 220 supports bristles 224 for forming a brush 225. The second end 222 of the shaft 220 is retained within the socket 130 by a press fit or frictional engagement with socket 130. In this example, the annular projection 136 within the socket 130 deforms the second end 222 of the shaft 220 to secure the brush 225 to the retainer 100. In the alternative, the second end 222 of the shaft 220 may be affixed within the socket 130 by an adhesive, sonic welding or any other conventional means.

The brush 225 is stored within the container 20. The threads 46 of the closure 30 are unscrewed from the threads 28 of the container 20 to expose the internally stored brush 225. The bristles 224 of the brush 225 transfer the applicator liquid 12 onto a surface in a conventional manner. The bristles 224 may be immersed within the container 20 to add more applicator liquid 12 to the brush 225 to be ultimately transferred to the surface. After use of the brush 225, the brush 225 is inserted into the container 20 and the threads 46 of the closure 30 are screwed onto the threads 28 of the container 20 to reseal the precision liquid applicator 10. The precision liquid applicator 10 permits the use of either the precision applicator tip 200 or a conventional brush to apply the applicator liquid 12.

Figure 15A:
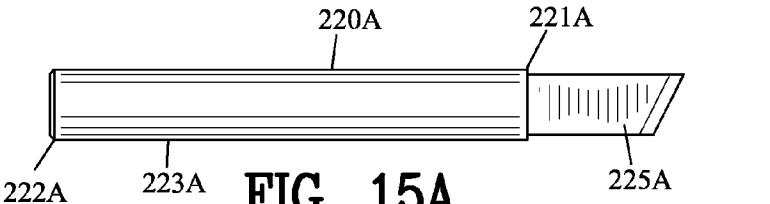
FIG. 15A is a side view of an alternate tool shown as a scraper for use with the precision liquid applicator.

FIG. 15A is a side view of an alternate tool 210A for use with the precision liquid applicator 10. The tool 210A comprises a shaft 220A extending between a first end 221A and a second end 222A with a scraper 225A defined on the first end 221A of the shaft 220A. The second end 222A of the shaft 220A is retained within the socket 130 as set forth previously with reference to FIG. 15.

Figure 15B:
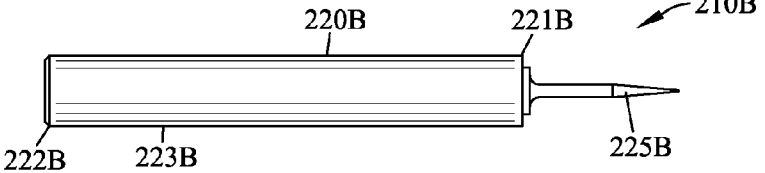
FIG. 15B is a side view of another alternate tool shown as a pick for use with the precision liquid applicator.

FIG. 15B is a side view of another alternate tool 210B for use with the precision liquid applicator 10. The tool 210B comprises a shaft 220B extending between a first end 221B and a second end 222B with a pick 225B defined on the first end 221B of the shaft 220B. The second end 222B of the shaft 220B is retained within the socket 130 as set forth previously with reference to FIG. 15.

Figure 16:
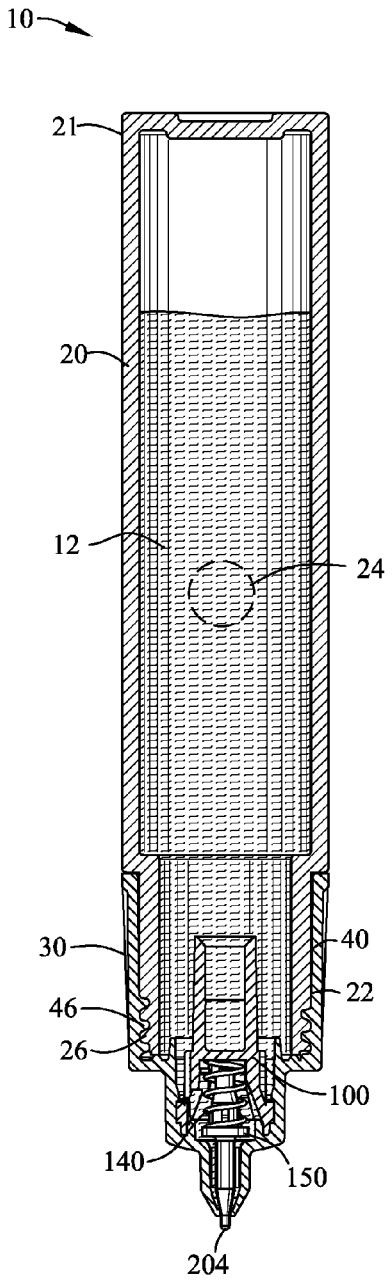
FIG. 16 is an enlarged sectional view along line 16-16 in FIG. 2 with the precision liquid applicator in a closed and inoperable position.
Figure 17:
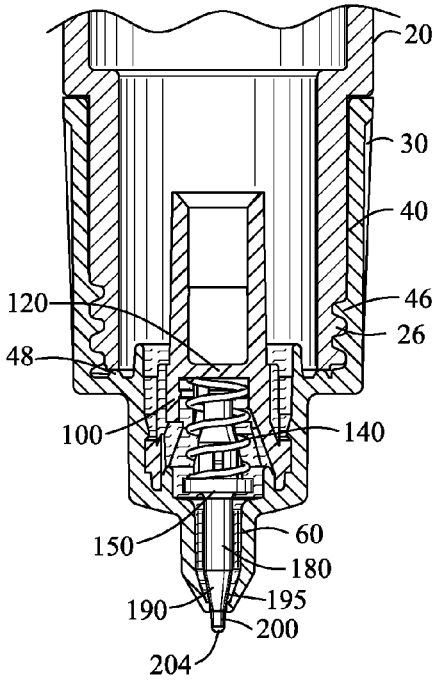
FIG. 17 is an enlarged view of a portion of FIG. 16.
Figure 18:
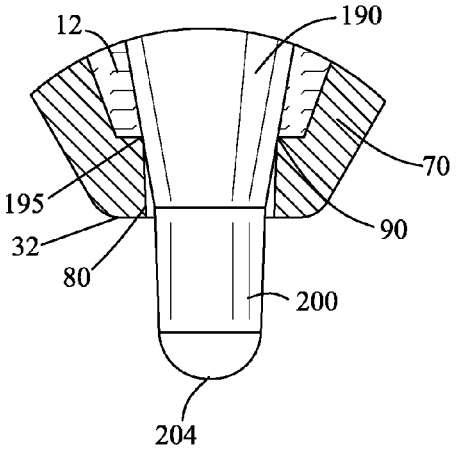
FIG. 18 is a magnified view of a portion of FIG. 17.

FIGS. 16-18 are sectional views illustrating the precision liquid applicator 10 in a closed and inoperative position. The applicator liquid 12 is retained within the container 20 when the precision liquid applicator 10 is in the closed and inoperative position. As best shown in FIG. 18, the spring 140 urges the valve seal 195 of the valve 150 into contact with the sealing seat 90 of the closure 30 creating a seal therebetween for inhibiting the flow of the applicator liquid 12 from the terminal orifice 80.

Figure 19:
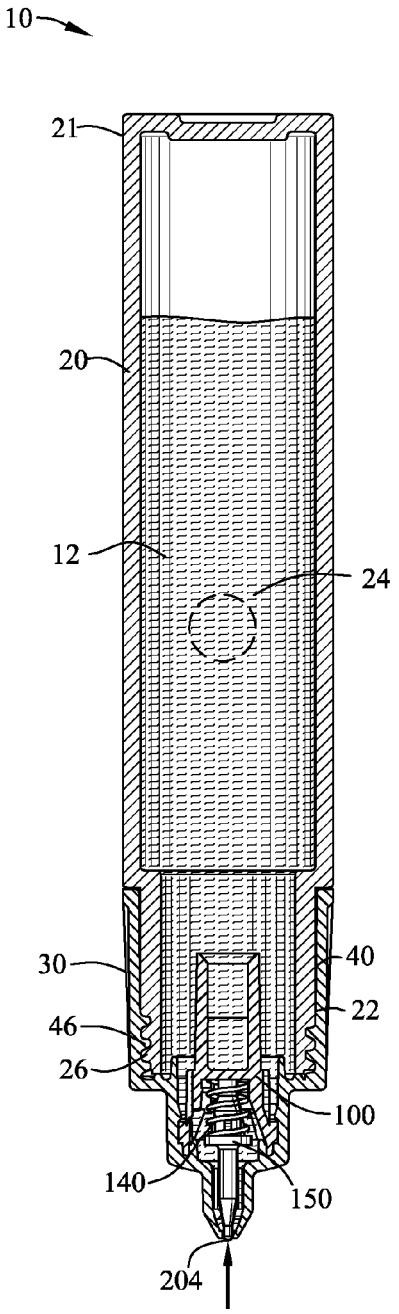
FIG. 19 is a view similar to FIG. 16 with the precision liquid applicator and an open and operating position.
Figure 20:
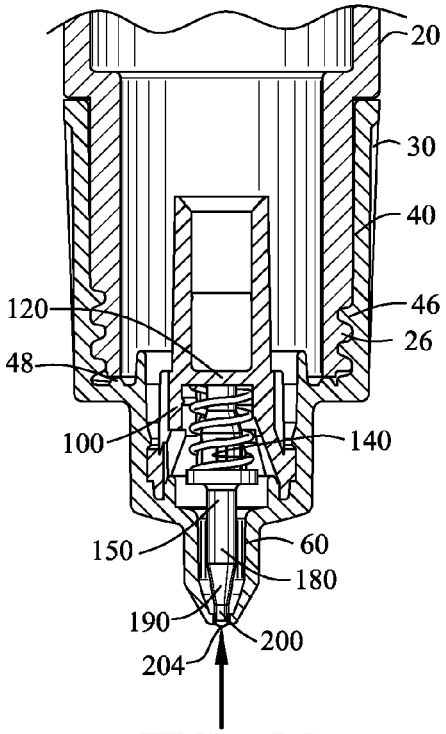
FIG. 20 is an enlarged view of a portion of FIG. 19.
Figure 21:
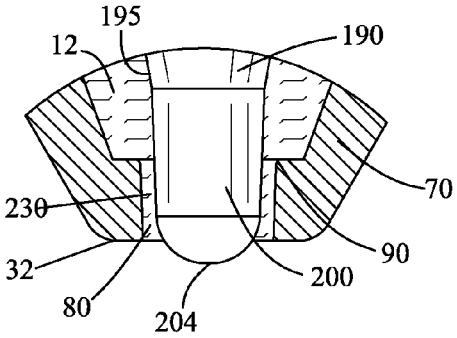
FIG. 21 is a magnified view of a portion of FIG. 20.

FIGS. 19-21 are sectional views similar to FIGS. 16-18 illustrating the precision liquid applicator 10 in an open and operative position. The applicator liquid 12 flows from the container 20 through the terminal orifice 80 when the precision liquid applicator 10 is in the open and operative position.

As best shown in FIG. 21, a depression of the precision applicator tip 200 onto surface as indicated by the arrow displaces the valve seal 195 from the sealing seat 90 of the closure 30 for providing an annular passageway 230 between the precision applicator tip 200 and the terminal orifice 90 to enable the flow of the applicator liquid 200 onto a surface.

As will be described in greater with reference to FIGS. 26-28, the valve stop 160 located on the valve 150 cooperates with the stop wall 120 for limiting the movement of the valve 150. The limited movement of the valve 150 by the stop wall 120 controls a cross-sectional area of the passageway 230 between the precision applicator tip 200 and the terminal orifice 80. In addition, the limited movement of the valve 150 by the stop wall 120 ensures the distal end 204 of the precision applicator tip 200 extends beyond the second end 32 of the closure 30.

Figure 22:
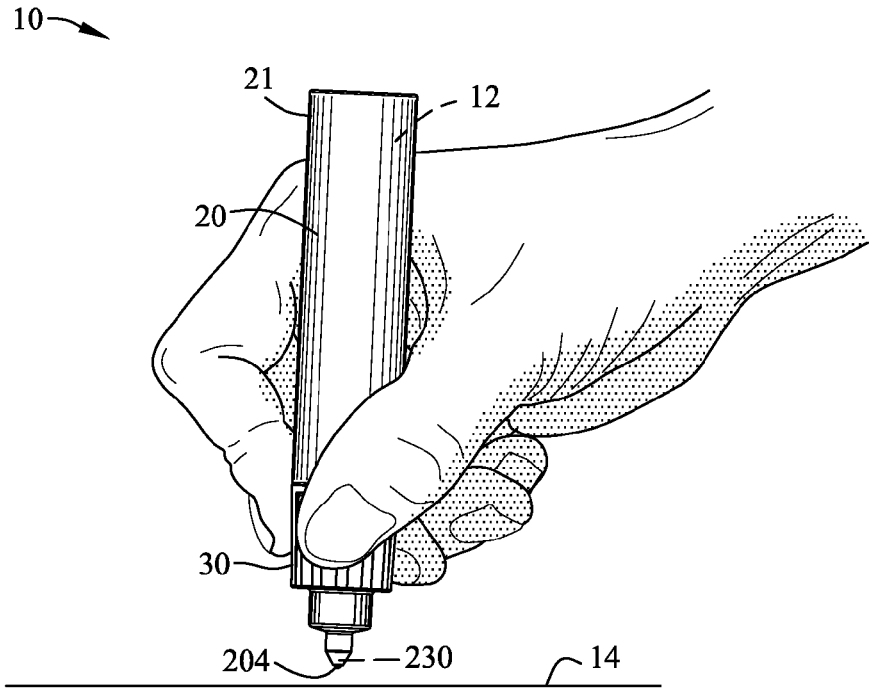
FIG. 22 illustrates the precision liquid applicator held by an operator in an operative position.

FIG. 22 is a view of the precision liquid applicator 10 positioned over a surface 14 by an operator 15. The applicator liquid 12 is free to flow into the closure 30 The spring 140 urges the valve seal 195 of the valve 150 into contact with the sealing seat 90 of the closure 30 creating a seal therebetween for inhibiting the flow of the applicator liquid 12 from the terminal orifice 80. In this example, the precision liquid applicator 10 is illustrated as dispensing a paint onto a surface 14.

Figure 23:
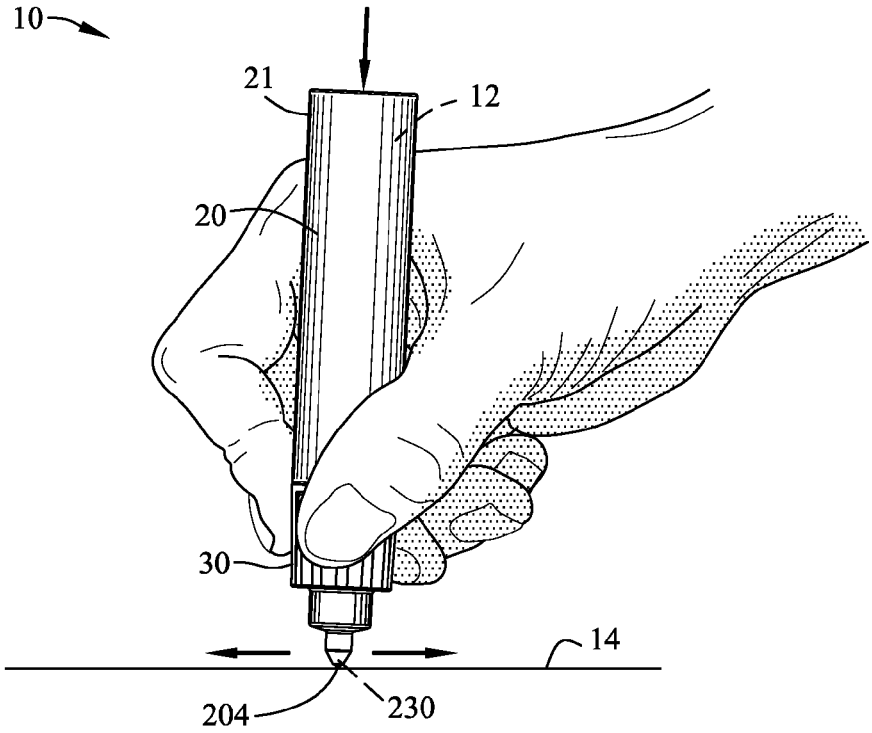
FIG. 23 illustrates a linear movement of the precision liquid applicator along a surface by the operator.

FIG. 23 is a view of the precision liquid applicator 10 impressed against the surface 14 by the operator 15 as illustrated by the vertical arrow. A depression of the precision applicator tip 200 against the surface 14 moves the valve 150 inwardly to displace the valve seal 195 from the sealing seat 90 of the closure 30. The separation of the valve seal 195 from the sealing seat 90 creates the annular passageway 230 between the precision applicator tip 200 and the terminal orifice 90 to enable the flow of the applicator liquid 12 onto the surface 14.

The applicator liquid 12 flows by action of gravity from the container 20 around the valve 150 to enter the annular passageway 230 between the precision applicator tip 200 and the terminal orifice 90. The precision liquid applicator 10 is moved laterally along the surface 14 for covering areas of the surface 14 as illustrated by the horizontal arrows. The applicator liquid 12 continues to flow by gravity and/or capillary action through the annular passageway 230 to the precision applicator tip 200.

Figure 24:
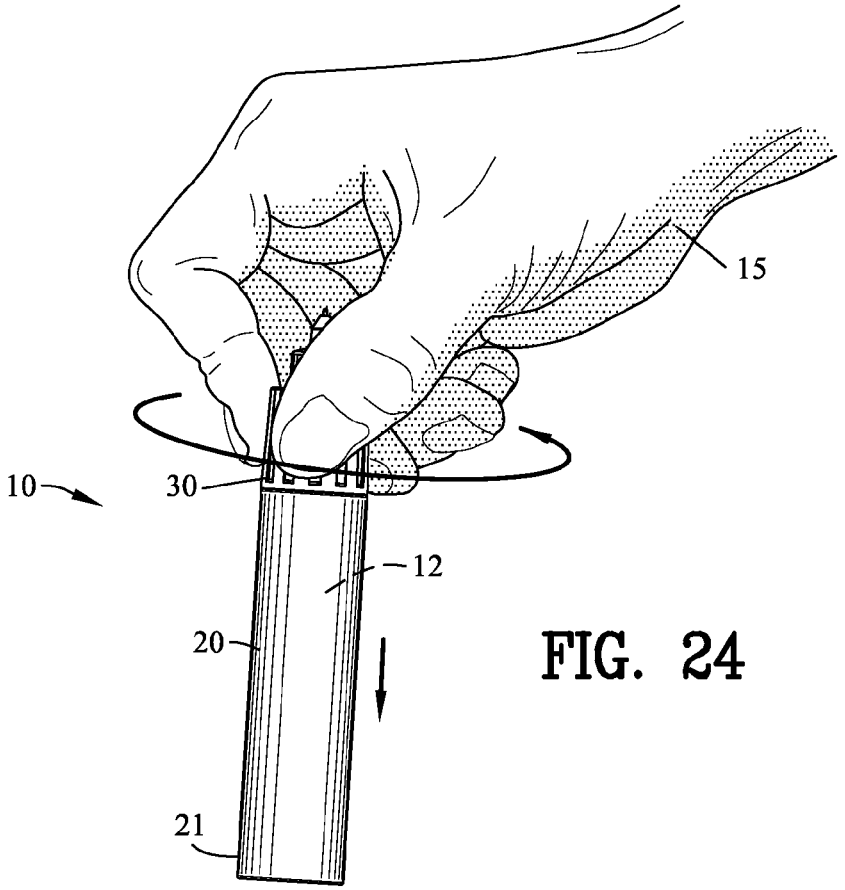
FIG. 24 illustrates the removal of the second embodiment of the precision liquid applicator of FIGS. 22-23 from a container.

FIG. 24 is a side view of a precision liquid applicator 10 illustrating the rotation of the closure 30 to remove the closure 30 from the container 20. The removal of the closure 30 from the container 20 exposes the auxiliary tool 210 stored within the interior of the container 20.

Figure 25:
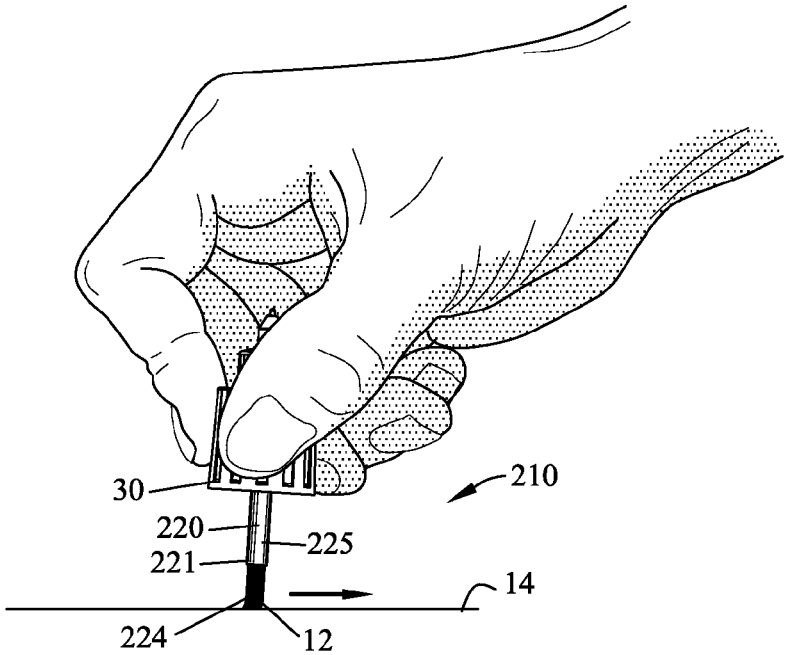
FIG. 25 illustrates the dispensing of the applicator liquid with the brush.

FIG. 25 is a side view of the internally stored tool 210 removed from the container 20 and dispensing the applicator liquid 12 onto the surface 14. The bristles 224 of the brush 225 transfer of the applicator liquid 12 onto the surface 14 in a conventional manner. The bristles 224 may be immersed within the container 20 to add more applicator liquid 12 to the brush 225 to be ultimately transferred to the surface 14. After use of the toot 210, the shaft 220 is insert into the container 20 and the threads 46 of the closure 30 is screwed onto the threads 26 of the container 20 to reseal the closure 30 to the container 20. The precision liquid applicator 10 permits the use of either the precision applicator tip 200 or the alternate brush 210.

Figure 26:
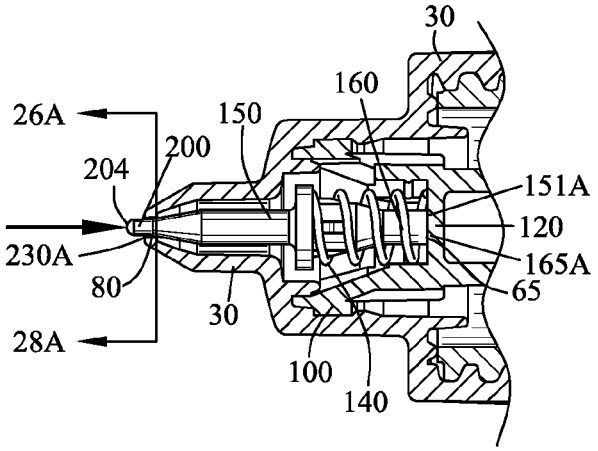
FIG. 26 illustrates the operating position of the valve incorporating the valve stop length A in FIG. 14.
Figure 27:
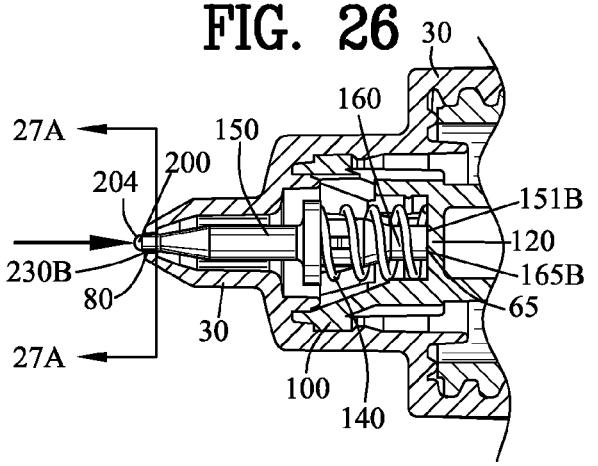
FIG. 27 illustrates the operating position of the valve incorporating the valve stop length B in FIG. 14.
Figure 28:
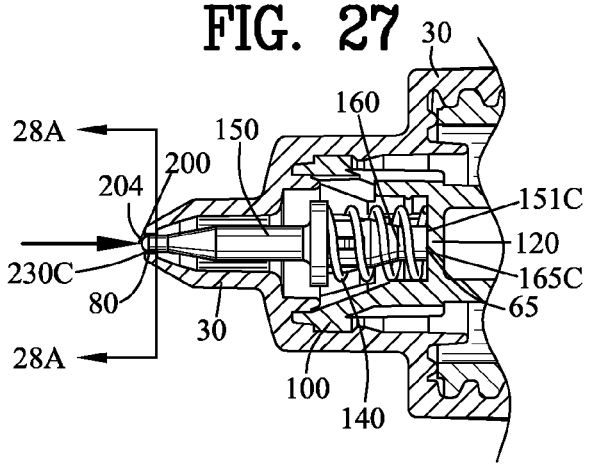
FIG. 28 illustrates the operating position of the valve incorporating the valve stop length C in FIG. 14.

FIGS. 26-28 illustrate the cooperation of the valve stop 160 of the valve 150 with the stop wall 120 for limiting the movement of the valve 150. The limited movement of the valve 150 by the stop wall 120 controls the cross-sectional area of the annular passageway 230 between the precision applicator tip 200 and the terminal orifice 80.

Figure 26A:
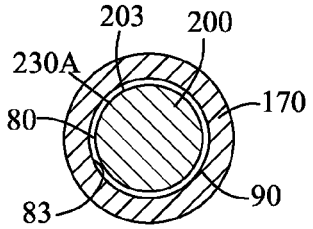
FIG. 26A is a sectional view along line 26A-26A in FIG. 26 illustrating a small annular orifice provided between the closure and the valve for permitting the flow of the applicator liquid therethrough.

FIGS. 26 and 26A illustrate the operating position of the valve 150 incorporating the valve stop 160 having the length A shown in FIG. 14. The valve stop 160 having the length A engages the valve stop surface 165A with the stop wall 120 provides an annular passageway 230A defining a small cross-sectional area between the precision applicator tip 200 and the terminal orifice 80. The small cross-sectional area between the precision applicator tip 200 and the terminal orifice 80 provides a small flow of the applicator liquid 12 to the precision applicator tip 200.

Figure 27A:
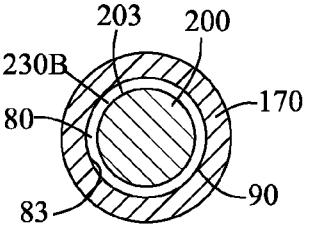
FIG. 27A is a sectional view along line 27A-27A in FIG. 27 illustrating a medium annular orifice provided between the closure and the valve for permitting the flow of the applicator liquid therethrough.

FIGS. 27 and 27A illustrate the operating position of the valve 150 incorporating the valve stop 160 having the length B shown in FIG. 14. The valve stop 160 having the length B engaging with the stop wall 120 provides an annular passageway 230B defining a medium cross-sectional area between the precision applicator tip 200 and the terminal orifice 80. The medium cross-sectional area between the precision applicator tip 200 and the terminal orifice 80 provides a medium flow of the applicator liquid 12 to the precision applicator tip 200.

Figure 28A:
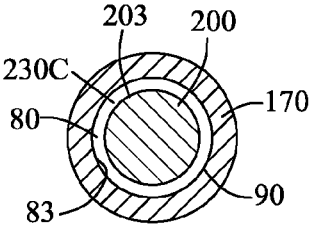
FIG. 28A is a sectional view along line 28A-28A in FIG. 28 illustrating a large annular orifice provided between the closure and the valve for permitting the flow of the applicator liquid therethrough.

FIGS. 28 and 28A illustrate the operating position of the valve 150 incorporating the valve stop 160 having the length C shown in FIG. 14. The valve stop 160 having the length C engaging with the stop wall 120 provides an annular passageway 230C defining a large cross-sectional area between the precision applicator tip 200 and the terminal orifice 80. The large cross-sectional area between the precision applicator tip 200 and the terminal orifice 80 provides a large flow of the applicator liquid 12 to the precision applicator tip 200.

The changing of the length of the valve 150 provides the ability to accommodate for various flow rates and various viscosities of the applicator liquid 12. In addition, the diameter of the terminal orifice 80 may be varied to provide the ability to accommodate for various flow rates and various viscosities of the applicator liquid 12. Preferably, the length of the valve 150 limits movement of the valve 150 by the stop wall 120 to ensure the distal end 204 of the precision applicator tip 200 always extends beyond the second end 32 of the closure 30.

FIGS. 29-34 illustrate one example of the use of the precision liquid applicator 10. In this example, the precision liquid applicator 10 is repairing a scratch 14S in a painted surface 14P overlying a substrate 14B. The painted surface 14P overlying the substrate 14B may be representative of a scratch 14S an automobile, truck, boat, airplane or any other painted surface overlying a substrate 14B.

Figure 29:
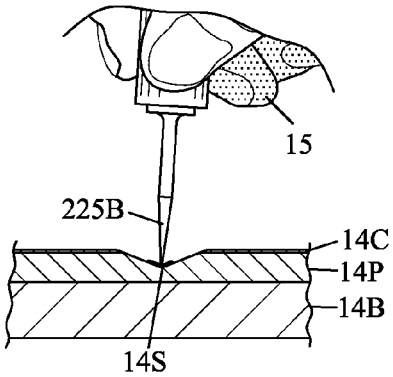
FIG. 29 is a sectional view of the alternate tool shown as a pick cleaning a scratch in a painted surface.

FIG. 29 is a sectional view of the tool 210 shown as the pick 225B cleaning a scratch 14S in the painted surface 14P. In this example, a protective coating 14C overlies the painted surface 14P. The pick 225B removes any loose material within the scratch 14S in the conventional manner.

Figure 30:
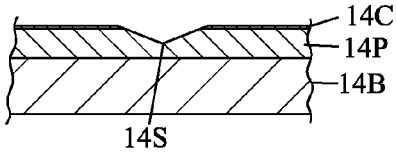
FIG. 30 is a sectional view illustrating the cleaned scratch in the painted surface of FIG. 29.

FIG. 30 is a sectional view illustrating the cleaned scratch 14S in the painted surface 14P of FIG. 29. The scratch 14S is shown free from loose material within the scratch 14S to provide a proper surface for the applicator liquid paint 12P.

Figure 31:
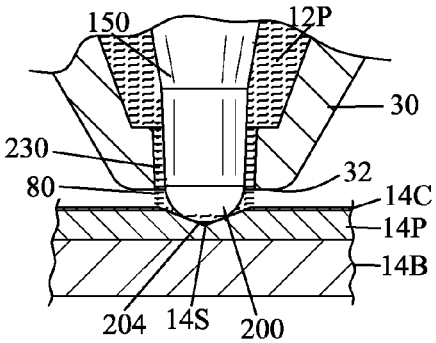
FIG. 31 is a sectional view of the precision liquid applicator applying a paint within the scratch in the painted surface.

FIG. 31 is a sectional view of the precision liquid applicator 10 applying the applicator liquid paint 12P within the scratch 14S in the painted surface 14P. In contrast to the applicators of the prior art, the precision liquid applicator 10 of the present invention is able to dispense very small quantities of the applicator liquid paint 12 into a very small area by the precision applicator tip 200.

Figure 32:
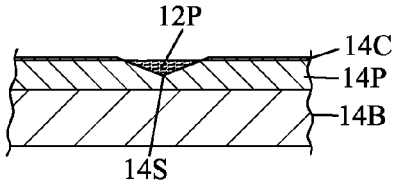
FIG. 32 is a sectional view of the paint located within the scratch in the painted surface of FIG. 31.

FIG. 32 is a sectional view of the applicator liquid paint 12P located within the scratch 14S in the painted surface of FIG. 31. The precision liquid applicator 10 of the present invention deposited the applicator liquid paint 12P into the scratch 14S with minimum application of the applicator liquid paint 12P to areas adjacent to the scratch 14S in the painted surface 14P.

Figure 33:
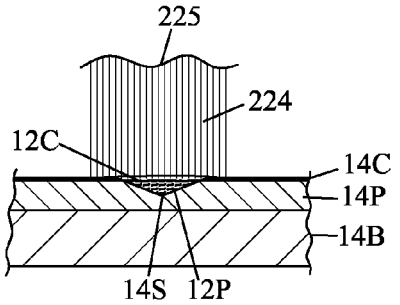
FIG. 33 is a sectional view of the alternate tool shown as a brush applying a paint material to the painted surface.

FIG. 33 is a sectional view of the tool 210 shown as the brush 225 applying applicator liquid paint 12 to the painted surface 14P. The brush 225 may be used to apply the applicator liquid paint 12 to larger surfaces of the painted surface 14P. In the alternative, the brush 225 may be used to apply a clear applicator liquid protective coating 12C over the applicator with a paint 12 as should be well known to those skilled in the art.

Figure 34:
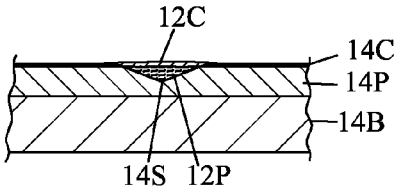
FIG. 34 is a sectional view of the completed repair of the scratch in the painted surface.

FIG. 34 is a sectional view of the completed repair of the scratch 14S in the painted surface 14P. The ability of the precision liquid applicator 10 of the present invention to dispense very small quantities of the applicator liquid paint 12P to very small areas of the painted surface 14P enables the precision liquid applicator 10 to deposit the applicator liquid paint 12P into the scratch 14S with minimum application of the applicator liquid paint 12 to adjacent areas. The precision liquid applicator 10 of the present invention enables quality repairs heretofore unknown in the art.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A precision liquid applicator for dispensing an applicator liquid from a container onto a surface, comprising:

a closure secured to the container;

said closure having an internal closure orifice defining a terminal orifice with a sealing seat adjacent to said terminal orifice;

a retainer defining a stop wall;

an aperture defined in said retainer for enabling the flow of the applicator liquid from the container to said terminal orifice;

a valve having a precision applicator tip with a. valve seal located adjacent to said precision applicator tip;

said valve seal having variable outer diameter extending between a first end and a second end of said valve seal with said first end of said valve seal having a large diameter and with said second end of said valve seal having a small diameter:

a retainer mount securing said retainer to said closure with said valve disposed between said retainer and said closure;

a biasing spring coacting between said retainer and said valve urging said valve seal of said valve into engagement with said sealing seat of said closure for inhibiting the flow of the applicator liquid from said terminal orifice;

a depression of said precision applicator tip upon the surface displacing, said valve seal from said sealing seat to enable the flow of the applicator liquid onto the surface; and a valve stop located on said valve engaging with said stop wall for limiting movement of said valve to establish a desired cross-sectional area of said passageway between said precision applicator tip and said terminal orifice upon total depression of said precision applicator tip to control the flow of the applicator liquid to minimize the application of the applicator liquid to areas adjacent to the intended area of application on the surface.

2. A precision liquid applicator as set forth in claim 1, wherein said sealing seat comprises an intersection of an outwardly tapered portion immediately adjacent to said terminal orifice of said closure.

3. A precision liquid applicator as set forth in claim 1, including a valve guide for aligning said valve within said closure.

4. A precision liquid applicator as set forth in claim 1, wherein said valve seal comprises an outwardly tapered region extending between said first and second ends of said valve seal with said first end of said valve seal having a large diameter and with said second end of said valve seal having a small diameter.

5. A precision liquid applicator as set forth in claim 1, wherein said precision applicator tip has a diameter less than 2.25 mm.

6. A precision liquid applicator as set forth in claim 1, wherein a dimension of one of said valve stop and said stop wall is selected relative to a viscosity of the applicator liquid for establishing a desired cross-sectional area of said passageway between said precision applicator tip and said terminal orifice to provide a desired flow of the applicator liquid to said precision applicator tip.

7. A precision liquid applicator for dispensing an applicator liquid from a container onto a surface, comprising;

a closure having an internal closure orifice extending therethrough;

a container minting for securing said closure to the container for enabling the applicator liquid to flow from the container into said internal closure orifice;

a terminal orifice defined in said closure;

a sealing seat defined by said closure adjacent to said terminal orifice;

a retainer defining a retainer cup having, a cylindrical sidewall and a stop wall;

an aperture defined in said a cylindrical sidewall of said retainer for enabling the flow of the applicator liquid from the container to said terminal orifice;

a valve having a valve stop and a precision applicator tip;

a valve seal located on said valve adjacent to said precision applicator tip;

said valve seal having variable outer diameter extending between a first end and a second end of said valve seal with said first end of said valve seal having a large diameter and with said second end of said valve seal having a small diameter;

a retainer mount securing said retainer to said closure with said valve interposed therebetween;

a biasing spring coacting between said retainer and said valve urging said valve seal of said valve into engagement with sealing seat of said closure for inhibiting the flow of the applicator liquid from said terminal orifice;

a depression of said precision applicator tip onto the surface displacing said valve seal from said sealing seat to enable the flow of the .applicator liquid onto the surface; and said valve stop located on said valve engaging with said stop wall for limiting movement of said valve to establish a desired cross-sectional area of said passageway between said precision applicator tip and said terminal orifice upon total depression of said precision applicator tip to control the flow of the applicator liquid to minimize the application of the applicator liquid to areas adjacent to the intended area of application on the surface.

8. A precision liquid applicator as set forth in claim 7, wherein an intersection of a tapered portion immediately adjacent to said terminal orifice defined said sealing seat of said closure.

9. A precision liquid applicator as set forth in claim 7, including a valve guide for aligning said valve within said closure.

10. A precision liquid applicator as set forth in claim 7, wherein said retainer has a retainer boss disposed on said retainer for engaging with said retainer mounting of said closure for securing said retainer to said closure.

11. A precision liquid. applicator as set forth in claim 7, wherein said precision applicator tip has a diameter less than 2.25 mm.

12. A precision liquid applicator as set forth in claim 7, wherein said valve includes an. award extending flange located intermediate a first and a second end of said valve for receiving an end of said biasing spring.

13. A precision liquid applicator as set forth in claim 7, wherein said valve seal extends between a first and a second end of said valve seal with said second end being adjacent to said precision applicator tip;

said second end of said valve seal having a small diameter and said first end of said valve seal having a large diameter; and said valve seal having an expanding tapered region located between said first and second ends of said valve seal.

14. A precision liquid applicator as set forth in claim 7, wherein a dimension of one of said valve stop and said stop wall is selected relative to a viscosity of the applicator liquid for establishing a desired cross-sectional area of said passageway between said precision applicator tip and said terminal orifice to provide a desired flow of the applicator liquid to said precision applicator tip.

15. A precision liquid applicator for dispensing an applicator liquid from a container onto a surface, comprising;

a closure defining a first end and a second end with an internal closure orifice extending therethrough;

a container mounting defined in said first end of said closure for securing said closure to the container for enabling. the applicator liquid to flow from the container into said internal closure orifice;

a retainer mounting disposed in said internal closure orifice intermediate said first and second end of said closure;

a terminal orifice defined in said second end of said closure;

a sealing seat extending from said terminal orifice toward said first closure end of said closure;

a retainer defining a first and a second end. with a stop wall interposed between said first and second ends of said retainer;

an aperture defined in said retainer between said stop wall and said first end of said retainer for enabling the flow of the applicator liquid from the container to said terminal orifice;

a valve having a valve stop defined on a first end of said valve and a precision applicator tip defined on a second end of said valve;

a valve seal located on said valve adjacent to said precision applicator tip;

said valve seal having variable outer diameter extending between a first end and a second end of said valve seal with said first end of said valve seal having a large diameter and with said second end of said valve seal having a small diameter;

a retainer receiving portion securing said retainer to said closure with said valve interposed therebetween;

a biasing spring coacting between said retainer and said valve urging said valve seal of said valve into engagement with sealing seat of said closure for inhibiting the flow of the applicator liquid from said terminal orifice;

a depression of said precision applicator tip onto the surface displacing said valve seal from said sealing surface for providing an annular passageway between said precision applicator tip and said terminal orifice to enable the continuous flow of the applicator liquid onto the surface; and said valve stop cooperating with said stop wall for limiting movement of said valve to control a cross-sectional area of said passageway between said precision applicator tip and said terminal orifice upon total depression of said precision applicator tip and for ensuring said precision applicator tip extends beyond said second end of said closure.

16. A precision liquid applicator for dispensing a paint liquid from a container onto a scratch in a painted surface, comprising:

a closure secured to the container;

said closure having an internal closure orifice defining a terminal orifice with a sealing seat adjacent to said terminal orifice;

a valve having a precision applicator tip with a valve seal located adjacent to said precision applicator tip;

said valve seal having variable outer diameter extending between a first end and a second end of said valve seal with said first end of said valve seal having a large diameter and with said second end of said valve seal having a small diameter;

said precision applicator tip having a diameter less than 2.25 mm for applying applicator liquid into the scratch in the painted surface;

a biasing spring urging said valve seal of said valve into engagement with said sealing seat of said closure for inhibiting the flow of the paint from said terminal orifice;

a depression of said precision applicator tip onto the scratch of the paint surface displacing said valve seal from said sealing surface for providing an annular passageway between said precision applicator tip and said terminal orifice to enable the flow of the paint into the scratch in the paint surface; and a valve stop located on said valve engaging with said stop wall for limiting movement of said valve to control a cross-sectional area of said passageway between said precision applicator tip and said terminal orifice for controlling the flow of the paint upon total depression of said precision applicator tip and to minimize the application of the paint to areas adjacent to the scratch in the paint surface.

* * * * *